US008048318B1

(12) United States Patent
Mogan

(10) Patent No.: US 8,048,318 B1
(45) Date of Patent: Nov. 1, 2011

(54) RECOVERING PACKAGED INGREDIENTS FROM MULTI-COMPONENT PRODUCT PACKETS

(75) Inventor: David Mogan, South Lyon, MI (US)

(73) Assignee: Heritage Environmental Services, LLC, Indianapolis, IN (US)

( * ) Notice: Subject to any disclaimer, the term of this patent is extended or adjusted under 35 U.S.C. 154(b) by 458 days.

(21) Appl. No.: 12/253,308

(22) Filed: Oct. 17, 2008

Related U.S. Application Data

(60) Provisional application No. 60/981,030, filed on Oct. 18, 2007.

(51) Int. Cl.
*B65D 35/28* (2006.01)
*B01D 17/00* (2006.01)

(52) U.S. Cl. ..... 210/767; 210/805; 241/30; 83/14; 414/412; 53/396; 53/147; 53/513; 206/497; 264/37.1; 222/94; 222/95; 220/500; 510/220; 510/235

(58) Field of Classification Search ..... 210/600, 210/767, 805; 83/13, 14, 23; 53/111 R, 53/147, 158, 167, 396, 513, 544; 206/497; 264/37.1; 222/94, 95; 220/500, 513; 241/30; 510/220, 221, 235, 236; 521/40; 414/411, 414/412

See application file for complete search history.

(56) References Cited

U.S. PATENT DOCUMENTS

| | | | | |
|---|---|---|---|---|
| 3,217,931 | A * | 11/1965 | Farrar et al. | 222/94 |
| 3,386,602 | A * | 6/1968 | Kanarek | 414/412 |
| 4,002,255 | A * | 1/1977 | Fincham et al. | 414/412 |
| 7,913,876 | B2 * | 3/2011 | Muenzenberger et al. | 222/94 |
| 2002/0035051 | A1 * | 3/2002 | Alam et al. | 510/218 |
| 2004/0106534 | A1 * | 6/2004 | Nitsch et al. | 510/220 |
| 2007/0090000 | A1 * | 4/2007 | Hjalmarsson | 206/219 |
| 2007/0119124 | A1 * | 5/2007 | Barthel et al. | 53/453 |
| 2009/0029897 | A1 * | 1/2009 | Behr et al. | 510/296 |

* cited by examiner

*Primary Examiner* — Joseph W Drodge
(74) *Attorney, Agent, or Firm* — Brinks Hofer Gilson & Lione

(57) ABSTRACT

A process for recovering packaged ingredients from multi-component product packets, comprises the steps of: (a) Providing a supply of multi-component product packets that contain at least two components; (b) orienting the multi-component product packets so that one of the components is in a desired position and feeding the oriented multi-component product packets to a breaching station; (c) breaching the multi-component product packets so as to access one of the components; (d) manipulating the multi-component product packets to collect the component accessed in step (c); and (e) further manipulating the multi-component product packets to release and collect another one of the components.

16 Claims, 3 Drawing Sheets

RECOVERING PACKAGED INGREDIENTS FROM MULTI-COMPONENT PRODUCT PACKETS

CROSS-REFERENCE TO RELATED APPLICATIONS

This application is related to, and claims the benefit of priority from, U.S. Provisional Patent Application Ser. No. 60/981,030, filed Oct. 18, 2007, the disclosure of which application is incorporated herein by reference in its entirety.

TECHNICAL FIELD

The present invention relates to multi-component product packets such as, for example, two-phase water-soluble product packets, and, more specifically, is directed to a process for recovering packaged ingredients from such product packets.

BACKGROUND ART

Water-soluble pouches usually contain powdered or dry product ingredients that effectively dissolve in water or other liquids in order to function properly. Recently, a way to combine a water-soluble pouch with both a concentrated, dry-powdered detergent and a liquid grease cutter in a single, water-soluble package has been developed as exemplified by Procter & Gamble's CASCADE 2-in-1 ACTIONPACS™.

Introduced in August, 2003, the mini dual-compartmented packets for automatic dishwashing detergent are made with a water-soluble film rollstock from MonoSol LLC (www.monosol.com). The cold-water-soluble film packets 10 hold concentrated, powdered CASCADE brand automatic dishwasher detergent in one compartment 11 and blue, liquid DAWN® grease-cutter in the other 12, providing consumers with one product that does the work of multiple products in the convenience of a single unit-dose packet (FIG. 1).

The cold-water-soluble film inner packets containing the automatic dishwasher product provide the cleaning benefits of both a powdered detergent and a liquid grease cutter, encapsulated in a single, easy-to-use premeasured dose. Thus, existing water-soluble film technology has moved a step further in packaging powder and liquid together.

MonoSol provides film rollstock for the packet, a customized cast-copolymer film based on DuPont's ELVANOL® polyvinyl alcohol (PVOH) and MonoSol's M-8630, the latter of which was modified for P&G's requirements, including Kosher certification. The film itself dissolves completely in the dishwasher, without leaving residue or waste behind.

Precisely how the water-soluble, biodegradable packets can contain both a powder and a liquid without dissolving is the main reason the ACTIONPACS™ won a gold award in DuPont's annual packaging competition for their dual-purpose functionality and packaging ingenuity. P&G itself is secretive about the product, and will only say it manufactures the dual-phase ACTIONPACS™ at an undisclosed plant in the U.S. using three webs of identical MonoSol water-soluble film rolls and a horizontal form/fill/seal machine that uses standard sealing technology.

MonoSol uses what it calls a solution-casting process to produce the filmstock for the ACTIONPACS™. Completely transparent, the packets allow the CASCADE brand's white, powdered detergent and bright blue liquid grease cutter to show through, which adds sales appeal and invites inspection. The combination of cleaners starts to dissolve as soon as the dishwasher begins its wash cycle.

In this case, the technology goes a step further in the challenge of using the film in packaging applications for a commercial product like this one. Several years ago, MonoSol was asked to conduct studies to find a water-soluble film package that could contain liquids. Today, MonoSol has a group of products that can successfully be used to package liquids including homecare detergents and cleaners and dish and laundry detergents. So while the use of water-soluble packaging film isn't new, MonoSol has managed to successfully package products in their water-soluble materials, including agrochemicals, detergents and some industrial chemicals.

One challenge with the P&G application was to ensure compatibility between the water-soluble film and the two products—the composition of the powder and the liquid are very different, but MonoSol was able to meet the challenge. Everything from solubility and compatibility to machinability and mechanical properties as well as the cost of the film were important.

Several issues existed and had to be overcome during the development of P&G's ACTIONPACS™, including chemical compatibility of the product, the value-in-use of the packaging and the difficult handling conditions of the film (given its variability in different heat and humidity conditions). At the time of development, there were single-phase, water-soluble products on the market but no two-phase water-soluble products. A new process had to be developed to produce the products.

One remaining challenge related to the production of two-phase water-soluble products involves the recovery of off-spec production runs for the purpose of reusing packaged ingredients.

SUMMARY OF THE DISCLOSURE

According to various features, characteristics and embodiments of the present invention which will become apparent as the description thereof proceeds, the present invention provides a process for recovering packaged ingredients from multi-component product packets which process involves the steps of:

(a) providing a supply of multi-component product packets that contain at least two components;

(b) orienting the multi-component product packets so that one of the components is in a desired position and feeding the oriented multi-component product packets to a breaching station;

(c) breaching the multi-component product packets so as to access one of the components;

(d) manipulating the multi-component product packets to collect the component accessed in step (c); and (e) further manipulating the multi-component product packets to release and collect another one of the components.

The multi-component product packets may comprise multi-phase packets or multi-component, water-soluble packets, including, for example, two-phase water-soluble product packets, such as, for instance, two-phase water-soluble product packets containing a dry component and a liquid component. One of the components may comprise a detergent. According to this aspect of the invention, the dry component may be accessed in step (c), while the liquid component may be accessed in step (e). In one embodiment, the packets may be pressed to extract a liquid component therefrom.

Per one feature thereof, the inventive method further comprises the step of detecting the orientation of the oriented packets in step (b). Improperly oriented packets may, according to another feature, be ejected and, furthermore, may be recycled to step (b) so as to be subject to orienting until they are oriented in a desired position.

According to one aspect of the inventive process, where one of the components comprises a dry component, in step (b) the packets are oriented so that the dry component is upward.

Per another feature of the invention, in step (d) the breached packets may be fed into a rotary separator.

According to one aspect of the invention, the process includes the step of recycling the collected components into a separate process for manufacturing additional multi-component product packets.

Per another feature, the breaching step may comprise cutting the product packets.

By the foregoing, the inventive process facilitates the recovery of packaged ingredients from multi-component product packets, including, by way of non-limiting example, two-phase, water-soluble product packets. The present invention can be used to recover ingredients from on- and/or off-spec production runs for purposes of reusing the ingredients in further/similar product production processes or in different product production processes. In addition, the process of the present invention can be used to separate components for disposal.

BRIEF DESCRIPTION OF DRAWINGS

Other advantages of the present invention will be readily appreciated as the same becomes better understood by reference to the following detailed description when considered with the accompanying drawings, wherein.

WRITTEN DESCRIPTION

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for teaching one skilled in the art to variously employ the present invention.

Figures 1, 2:
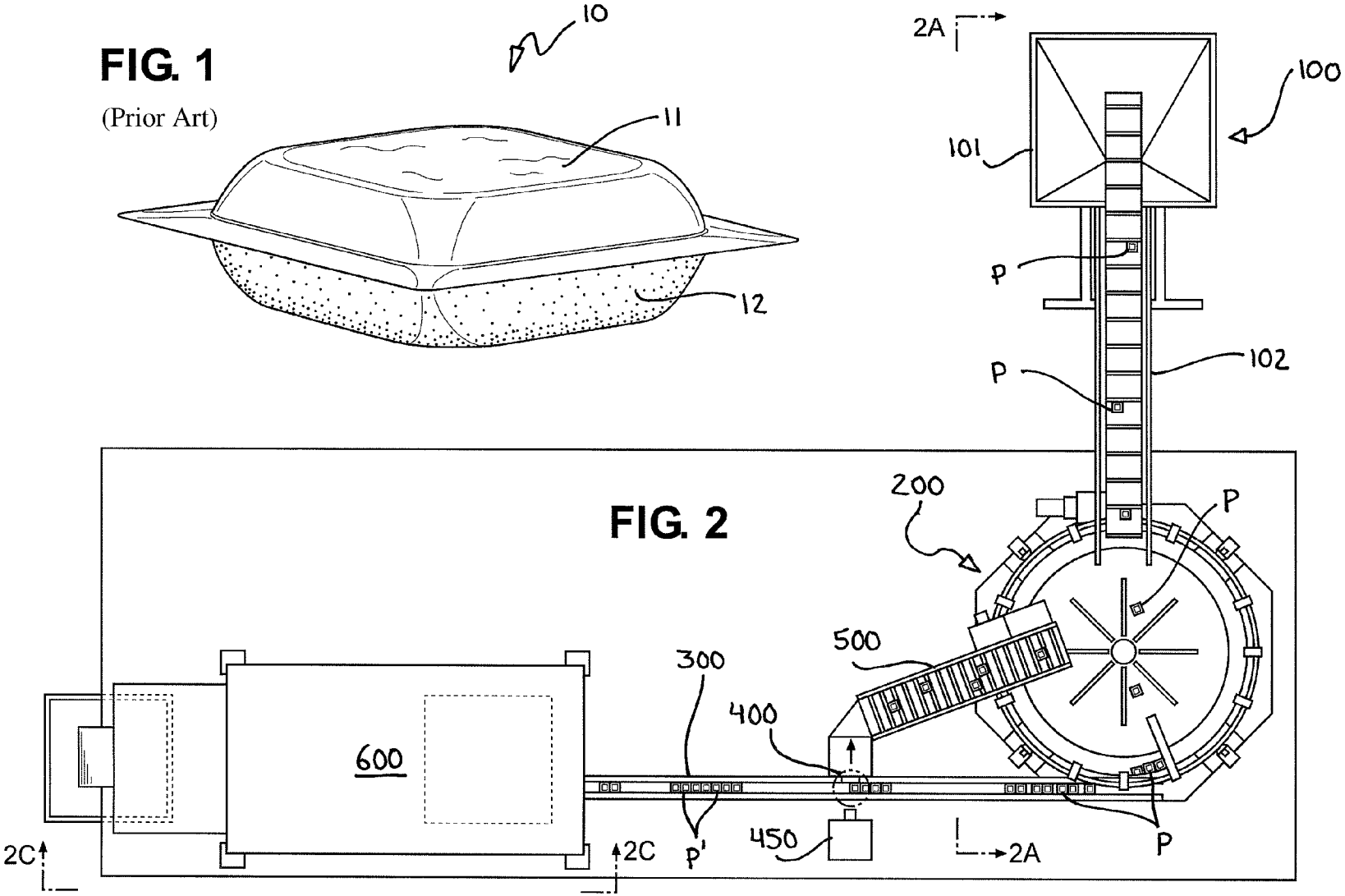
FIG. 1 (Prior Art)
FIG. 1 depicts in perspective view an exemplary multi-component product packet in the form of the commercially available ACTIONPACS™ (Proctor & Gamble, Cincinnati, Ohio)
FIG. 2 is a plan view of an exemplary processing line for carrying out the inventive process.
Figure 2A:
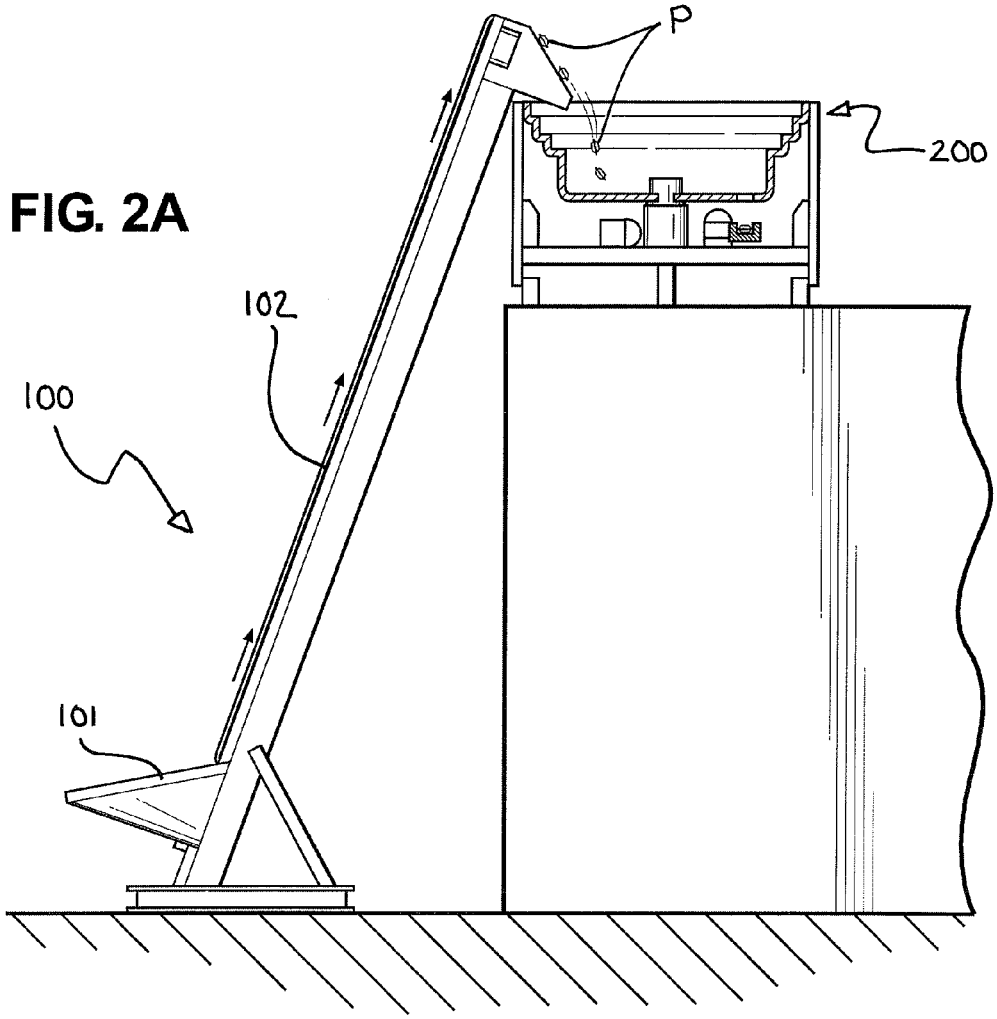
FIG. 2A is an elevational view showing a portion of the exemplary processing line.
Figure 2B:
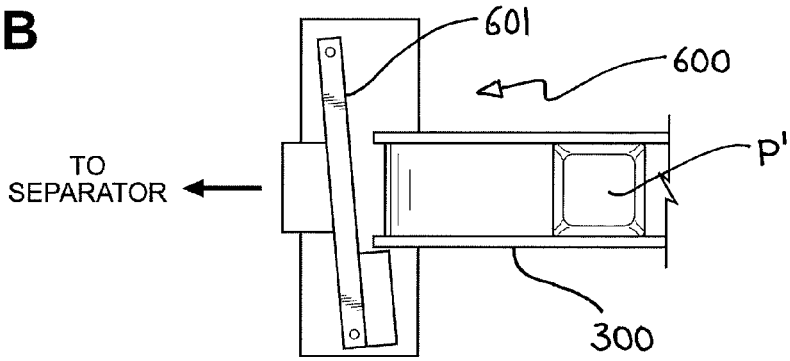
FIG. 2B is detailed plan view showing the portion of the exemplary processing line for carrying out the step of cutting the multi-component product packets.
Figure 2C:
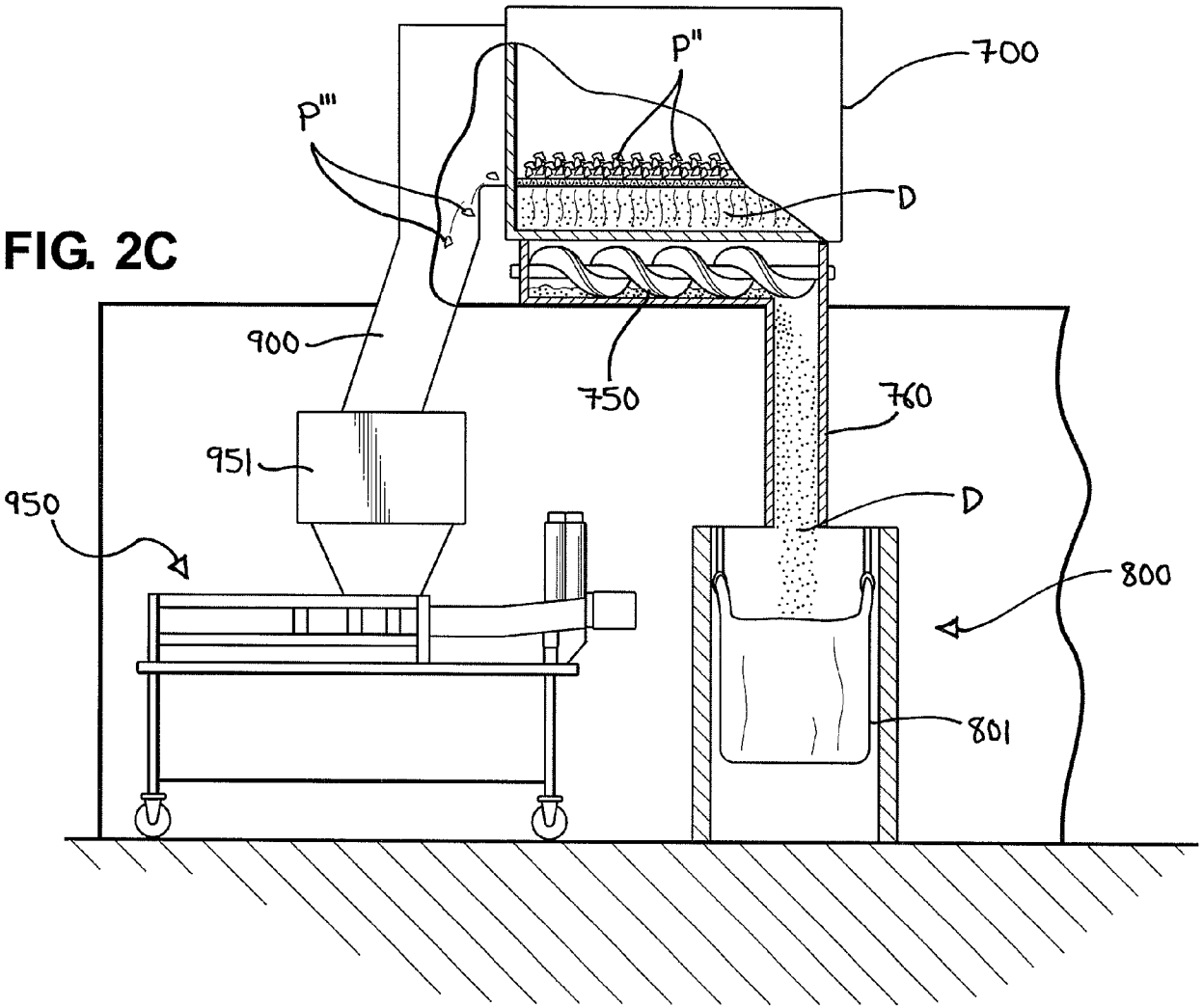
FIG. 2C is an elevational view showing a portion of the exemplary processing line for carrying out the steps of manipulating the multi-component product packets to collect the components thereof.

Referring to FIGS. 2 through 2C, the process for recovering packaged ingredients from multi-component product packets, shown in an exemplary processing line for the performance thereof, generally comprises the steps of: (a) providing a supply of multi-component product packets that contain at least two components; (b) orienting the multi-component product packets so that one of the components is in a desired position and feeding the oriented multi-component product packets to a breaching station; (c) breaching the multi-component product packets so as to access one of the components; (d) manipulating the multi-component product packets to collect the component accessed in step (c); and (e) further manipulating the multi-component product packets to release and collect another one of the components.

In the exemplary processing line for carrying out the invention, a supply of multi-component product packets that contain at least two components are provided. In the illustrated embodiment, these multi-component product packets are shown and described as two-phase water-soluble products, such as the CASCADE ACTIONPACS™ previously discussed. It should be understood, however, that the inventive process is not so limited. For instance, the process described herein can be readily adapted to recover packaged ingredients from product packets that contain multiple, common phase components as well as product packets that contain more than two ingredient components whether single- or multiple-phase components. In addition, the process of the present invention is not at all limited to recover packaged ingredients from dishwasher detergent packets, but can be used in conjunction with any type of multi-component (including multi-phase) product packets. It is noted that, as used herein, reference to a liquid component includes not only conventionally recognized liquids, but also gels, pastes and other viscous liquid-phase components.

As initially provided, it will be understood that these product packets are randomly oriented in containers such as, for instance, self-dumping totes. From such containers or other collection means, the product packets P will be received in a feed source 100. The feed source can be a hopper which meters the amount of product packets P that are fed into the process. In the illustrated embodiment, the feed source 100 comprises an inclined conveyor 102 with a cleated belt conveyor the speed of which is variable as desired. Conveyor 102 is fed product packets P by a hopper 101 (as depicted, an 8 cubic foot hopper) provided adjacent the lower end of the conveyor (FIGS. 2 and 2A).

The overall process involves orienting the product packets in a desired orientation, so that after being oriented, they can be processed in a continuous manner. In general, such orientation is necessary because the processing contemplated by the present invention is a post-manufacturing process. That is, while the product packets can be generally uniformly oriented during manufacturing, after manufacturing the product packets are randomly oriented as they are packaged and/or otherwise collected. To this end, the feed source 100 feeds the product packets P into one or more centrifugal bowl feeders 200 that will orient and feed the product packets single-file onto a conveyor 300. As best shown in FIG. 2A, the centrifugal bowl feeder 200 is, in the exemplary embodiment, vertically elevated relative to the hopper 100. Of course, the disposition of the feeder 200 relative to the feed source 100 need not be so limited.

The centrifugal bowl feeder 200 uses an angled, spinning disk to cast the product packets P to the outer edge of the bowl. According to the illustrated embodiment, the centrifugal bowl feeder 200 includes a variable speed motor so that the speed may be modified as desired. For automated operation, a photoeye or other sensing means for determining the height level of product packets P disposed in the bowl feeder 200 may be employed. Upon sensing a predetermined height of packets supplied thereto by the feed source 100, the feed source 100 may be slowed or stopped until the packet level is diminished as sensed by the photoeye or other sensing means.

As the product packets P accumulate at the outer edge of the centrifugal feeder bowl 200, they are stabilized and fed onto conveyor 300 (in the exemplary embodiment, at a rate of approximately 600 packets per minute) where they travel single-file past an orientation detector 400 operative to determine which of the component phases of the product packets P is presently upwardly oriented. Such an orientation detector can take the form, for instance, of an optical detector, such as shown (commercially available from Cognex Corporation, Natick, Mass.), that is operative to detect the color difference between the components contained in the exemplary CASCADE ACTIONPACS™ two-phase water-soluble product packets. Of course, other detectors may be substituted, depending, for instance, on the nature of the product packets being processed.

According to the exemplary embodiment of the present invention, the two-phase water-soluble product packets are preferably oriented so that the dry component is oriented upward as the two-phase water-soluble product packets are transferred along the conveyor 300. Accordingly, when the orientation detector 400 detects product packets that are improperly oriented (i.e., with the liquid component on the top), such two-phase water-soluble product packets are ejected from the conveyor 300 and sent back into the one of the one or more centrifugal bowl feeders 200 via a return conveyor 500. The ejection of the improperly oriented two-phase water-soluble product packets onto return conveyor 500 can be accomplished by any known means, such as mechanical means, pneumatic means, etc. According to the illustrated embodiment, one or more air jets 450 are provided, the air jets 450 being operatively connected to the orientation detector 400 so as to force from the conveyor 300, by a jet of air, product packets P in response to the orientation detector 400 sensing such product packets to be improperly oriented.

As properly oriented product packets P' are transported along the conveyer 300 (or conveyors when including parallel lines from multiple centrifugal bowl feeders), they are directed through a breaching station 600 in which one or more cutting blades 601 breach or cut the packets to access or release the dry component. In the exemplary embodiment, two such cutting blades are provided, each comprising a 12" diameter, stainless steel, scalloped knife blade. Preferably, though not necessarily, the height and speed of each cutting blade 601 is adjustable. Of course, it is contemplated that other means could be substituted for breaching the product packets, including, for example, lasers, needles, etc.

According to the exemplary embodiment, the two-phase water-soluble product packets are cut either along their tops or along the sides near their tops (with the dry component oriented upward as described above). However, it is possible according to an alternative embodiment of the present invention to orient the two-phase water-soluble packets so that the dry component is on the bottom or lower side and use a cutting station that cuts the bottom portion of the packets. In this alternative embodiment, any dry component that falls downward can be collected in a receiving hopper and recycled in further/similar product production processes or in different product production processes or disposable in the case of an off-spec component. It is also possible to orient the components of the packets sideways rather that upwards or downwards in which case the cutting station 600 would be configured to cut one of the sides of the packets.

Cut packets P" are transported from cutting station 600 by a conveyor or other means and fed into a rotary separator 700 in which the dry component of the packets is separated from the rest of the packet. In the exemplary embodiment, rotary separator 700 comprises a rotating drum (3 feet in diameter and 6 feet long) with a mesh screen 701 sized to permit passage therethrough of the dry component D only. In the illustrated embodiment, this mesh screen 701 is a number 6 mesh.

As the drum rotates, the cut packets P" are agitated to urge the release of the dry component D therefrom. The thus-separated dry component flows through the mesh screen 701 and into a screw conveyor 750 (in the illustrated embodiment of the invention, having a 12" diameter auger) disposed beneath the separator 700. The screw conveyor moves the dry component D toward a chute 760 where it is fed by gravity to a collection station 800 comprising, according to the illustrated embodiment, collection bags 801 for receiving and holding a quantity of the dry component. As each such collection bag 801 is filled, it is removed from the collection station 800 and another, empty bag put in its place to continue receiving dry component from the chute 760. The dry component D released from the two-phase water-soluble product packets can be recycled, reused, discarded or subjected to some other process.

The partially empty product packets P"', now only containing a liquid-phase component, are prevented from flowing into screw conveyor 750, and are instead discharged from the rotary separator 700 and transported and/or fed via a chute 900, for instance, into the hopper 951 of an extractor press 950 in which they accumulate until a desired amount, e.g. level, of packets P"' are received. In the exemplary embodiment, the extractor press 950 comprises an extruder of the type commercially available from Sebright Products, Inc. (Hopkins, Mich.).

The extractor press 950 will press the liquid phase component out of the packets for collection, disposal, recycling or other processes. According to the exemplary embodiment, it is contemplated that the extractor press may include a discharge conduit (not shown) via which the liquid phase component is transferred to a desired destination, such as, for instance, a storage tank (not shown).

The water-soluble packaging material moves from the extractor into a collection hopper or other collector (not shown), from where it may be transferred to another location for further processing, such as, for example, to a trash compactor for compacting prior to disposition in a landfill.

While the inventive process is described herein according to an exemplary processing line, it is to be understood that this process may be carried out in other manners and by other means, including, without limitation, with other types of commercially available equipment. For example only, other means can be used to orient and transfer the packets and to separate the dry component from the cut packets and to extract the liquid-phase component from the packets. Likewise, those skilled in the art will recognize that multiple parallel lines can be used and/or multiple pieces of equipment.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above and the scope of the attached claims.

The invention claimed is:

1. A process for recovering packaged ingredients from multi-component product packets which process comprises the steps of:

(a) providing a supply of multi-component product packets that contain at least two components;

(b) orienting the multi-component product packets so that one of the components is in a desired, discrete position and feeding the oriented multi-component product packets to a breaching station;

(c) breaching the multi-component product packets so as to access one of the components;

(d) manipulating the multi-component product packets to collect the component accessed in step (c); and (e) further manipulating the multi-component product packets to release and collect another one of the components.

2. A process for recovering packaged ingredients from multi-component product packets according to claim 1, wherein the multi-component product packets comprise two-phase water-soluble product packets.

3. A process for recovering packaged ingredients from multi-component product packets according to claim 2, wherein the two-phase water-soluble product packets contain a dry component and a liquid component.

4. A process for recovering packaged ingredients from multi-component product packets according to claim 3, wherein in step (c) the dry component is accessed.

5. A process for recovering packaged ingredients from multi-component product packets according to claim 3, wherein in step (e) the liquid component is accessed.

6. A process for recovering packaged ingredients from multi-component product packets according to claim 1, wherein in the multi-component product packets comprise multi-component water-soluble packets.

7. A process for recovering packaged ingredients from multi-component product packets according to claim 1, wherein in the multi-component product packets comprise multi-phase packets.

8. A process for recovering packaged ingredients from multi-component product packets according to claim 1, wherein in step (e) the packets are pressed to extract a liquid component.

9. A process for recovering packaged ingredients from multi-component product packets according to claim 1, wherein one of the components comprises a detergent.

10. A process for recovering packaged ingredients from multi-component product packets according to claim 1, wherein one of the components comprises a dry component and in step (b) the packets are oriented so that the dry component is upward.

11. A process for recovering packaged ingredients from multi-component product packets according to claim 1, wherein in step d) the breached packets are fed into a rotary separator.

12. A process for recovering packaged ingredients from multi-component product packets according to claim 1, further comprising recycling the collected components into a separate process for manufacturing additional multi-component product packets.

13. A process for recovering packaged ingredients from multi-component product packets according to claim 1, further comprising the step of detecting the orientation of the oriented packets in step (b).

14. A process for recovering packaged ingredients from multi-component product packets according to claim 13, further comprising the step of ejecting improperly oriented packets.

15. A process for recovering packaged ingredients from multi-component product packets according to claim 14, wherein the ejected packets are recycled to step (b).

16. A process for recovering packaged ingredients from multi-component product packets according to claim 1, wherein step (b) comprises feeding the oriented multi-component product packets to a cutting station, and step (c) comprises cutting the multi-component product packets so as to access one of the components.

* * * * *